US006006063A

United States Patent [19]

Shimizu et al.

[11] Patent Number: 6,006,063

[45] Date of Patent: Dec. 21, 1999

[54] FIXING APPARATUS AND IMAGE FORMING APPARATUS PROVIDED WITH THE SAME

[75] Inventors: Tadafumi Shimizu; Hidehiko Inokuchi, both of Ogori; Tetsuya Mitsuyasu; Hiroyuki Noda, both of Kurume; Junichi Terayama, Kurume, all of Japan

[73] Assignee: Matsushita Electric Industrial Co., Ltd., Osaka, Japan

[21] Appl. No.: 09/255,267

[22] Filed: Feb. 23, 1999

[30] Foreign Application Priority Data

Mar. 6, 1998 [JP] Japan ..... 10-054678

[51] Int. Cl.[6] ..... G03G 15/00; G03G 15/20

[52] U.S. Cl. ..... 399/325; 399/107

[58] Field of Search ..... 399/324, 325, 399/352; 118/59, 60

[56] References Cited

U.S. PATENT DOCUMENTS 5,576,821 11/1996 Rasch et al. ..... 399/352

5,848,341 12/1998 Watanabe ..... 399/352

*Primary Examiner*—Arthur T. Grimley

*Assistant Examiner*—Hoang Ngo

*Attorney, Agent, or Firm*—Stevens, Davis, Miller & Mosher, L.L.P.

[57] ABSTRACT

A fixing roller cooperates with a pressing roller to heat and press a toner image to a recording medium so as to fix the toner image to the recording medium. A sheet-like web is impregnated with a mold release for supplying the mold release to a surface of the fixing roller by being pressed by the pressing roller. A first shaft has an unused portion of the web wound therearound, and a second shaft takes up the web after supplying the mold release to the fixing roller. A coil spring applies a rotational force in a direction opposite to a direction of drawing out the web relative to the first shaft so as to apply a tension to the web, thereby automatically removing slackness of the web.

2 Claims, 6 Drawing Sheets

FIXING APPARATUS AND IMAGE FORMING APPARATUS PROVIDED WITH THE SAME

BACKGROUND OF THE INVENTION

1. Field of the Invention

The present invention relates to a fixing apparatus and an image forming apparatus provided with the same, and particularly relates to a removal of slackness of a web (corresponding to a roll of papers, actually a non-woven fabric is used) for supplying a mold release onto a surface of a fixing roller.

2. Description of the Prior Art

In a conventional fixing apparatus of an image forming apparatus using an electrophotographic system, there are employed various kinds of techniques for applying a mold release such as a silicone oil and the like to a fixing roll so as to prevent a toner from offsetting. Particularly, in a full color image forming apparatus in which a plurality of different color toners are mixed, since the fixing roll requires a very high mold release property, a large amount of mold release is applied to the fixing roll.

Here, in the conventional technique, the mold release as been mainly supplied by a structure in which a roll and he like impregnated with the mold release such as a silicone oil and the like is directly brought into contact with the surface of the fixing roll. However, in the impregnated roll system, a supply amount of the mold release is varied in accordance with a change with the passage of time, so that there is a problem that an offset effect is not maintained for a long time.

Then, in order to solve this problem, there has been suggested a sheet type mold release supplying structure which takes up a web integrated with a mold release while bringing the web into contact with the fixing roll.

Next, an image forming apparatus in which a fixing apparatus in accordance with a conventional sheet type mold release supplying structure is employed will be explained below.

A development unit for receiving toners respectively corresponding to black (B), cyan (C), magenta (M) and yellow (Y), a charging unit for charging a photosensitive body belt due to a corona discharge and the like are provided along an outer peripheral surface of the photosensitive body belt which is coated with a photosensitive image receiving layer and circulates. Further, there is provided a laser scanning unit (an LSU) incorporating a semiconductor laser element therein and irradiating a laser beam onto the photosensitive body belt while turning on and off the laser beam in correspondence to the image data so as to form an electrostatic latent image. Still further, in opposition to the photosensitive body belt, an intermediate transferring body belt on which the toner image on the photosensitive body belt is transferred is placed.

Then, a paper feeding path is formed in such a manner as to be brought into contact with the circulating intermediate transferring body belt, and the toner image formed on the intermediate transferring body belt in an overlapping manner is transferred to the paper conveyed on the paper feeding path.

A fixing apparatus is placed in a downstream side of the paper feeding path, and an unfixed toner image transferred to the paper is heated and pressure fixed by the fixing apparatus.

Here, a structure of the fixing apparatus for fixing the toner image to the paper will be described below.

FIG. 6 is a schematic view which shows a structure of the fixing apparatus in a conventional image forming apparatus.

The fixing apparatus has a fixing roller 8 heated so that a temperature of a surface becomes an optimum fixing temperature (160° C. to 180° C.) by an internal or external heat source, a pressurizing roller 9 for holding the conveyed unfixed toner image therebetween together with the paper, and a web unit 10 corresponding to mold release applying means for applying a silicone oil as a mold release to the fixing roller 8 and cleaning the surface of the fixing roller 8 finishing a fixing operation.

The web unit 10 is constituted by a first shaft 12*a* formed by a sheet-like member made of a non woven fabric and a porous material and around which a web 11 impregnated with the mold release such as a silicone oil is wound, a second shaft 12*b* applying the mold release onto a surface of the fixing roller 8 and taking up the used web 11 having a surface cleaned, and a friction plate 13 brought into contact with the unused web 11 wound around the first shaft 12*a*, that is, an outer peripheral surface of the web roll by means of urging means (not shown) such as a spring and the like. Then, the web 11 is brought into contact with the surface of the fixing roller 8 by a pressing roller 14 from a side of a back surface.

In this case, the fixing roller 8 is structured such that an elastic layer 16 made of a high temperature vulcanized silicone rubber (an HTV silicone rubber) is formed on a core bar 15 made of an aluminum, an oil resistant layer F made of a fluoro rubber is formed on the elastic layer 16, and an offset prevention layer 17 made of a regular temperature vulcanized silicone rubber (an RTV silicone rubber) is further formed thereon. In this case, an outer diameter of the fixing roller 8 is, for example, set to 40 mm.

The pressing roller 9 is structured such that an elastic layer 19 made of the HTV silicone rubber is formed on a core bar 18 made of an aluminum, and a resin layer 20 made of a fluoro resin is formed on the elastic layer 19. An outer diameter of the pressing roller 9 is, for example, set to 40 mm.

A halogen heater 21 is arranged within each of the core bar 15 of the fixing roller 8*a* and the core bar 18 of the pressing roller 9. Then, it is structured such that a temperature of the fixing roller 8 is detected by a thermistor 22 brought into contact with the fixing roller 8 so as to turn on and off the halogen heater 21, thereby constantly maintaining the temperature of the fixing roller 8 to about 165° C.

The web unit 10 is structured so as to press the web 11 impregnated with the silicone oil having a viscosity 500 cS to the fixing roller 8 by the pressing roller 14 by uniformly feeding the web 11 through a drive gear 25A of a drive mechanism 25 so as to be wound around the second shaft 12*b*, thereby applying the web 11 to the offset prevention layer 17 of the fixing roller 8, and at the same time of this, a toner offset (attached) to the offset prevention layer 17 of the fixing roller 8 is removed. Further, the friction plate 13 pressure contacted on the outer periphery of the web roll generates a friction force in the web roll at a time when the web 11 is taken up due to the pressing force, and applies a proper tension to the web 11 interlinked between the first shaft 12*a* and the second shaft 12*b*.

In this case, the web unit 10 is detachably mounted to the main body of the fixing apparatus, and is structured so as to be replaced when fully using the web 11.

In accordance with the web unit 10 structured in the above manner, the layered toner image can be thermally fixed on the paper in a mixed manner by passing the paper carrying a plurality of unfixed toner images in a layered manner between the rotating fixing roller 8 and pressing roller 9 in a gripping manner, so that a full color image can be formed.

However, in accordance with the conventional technique mentioned above, even in the case that a slackness is generated in the web 11 at a time of replacing the web unit 10 and manually rotating the fixing roller 8 in an inverse direction for removing a paper in accordance with a jamming operation, the slackness can not be removed and a printing operation is performed in a loosened state. Further, when feeding the web 11 in a state that no tension exists in the web 11, rumples are generated in the web 11 at a pressure contact portion with respect to the pressing roller 14, so that an adhesion property to the surface of the fixing roller 8 is deteriorated. Accordingly, an application unevenness of the silicone oil corresponding to the mold release is generated, so that the toner can be easily attached to the surface of the fixing roller 8. Therefore, a generating rate of the offset is increased and a cleaning performance of the surface of the fixing roller 8 is decreased.

Further, when driving the fixing roller 8 in a state that the web 11 is loosened, a contact area between the web 11 and the fixing roller 8 becomes wider than that of a normal state due to a slackness of the web 11, so that a friction load due to the fixing roller 8 is increased. Accordingly, there has been a problem that the web 11 taken up in the second shaft 12*b* is inversely drawn due to an excess friction load and is inversely returned.

SUMMARY OF THE INVENTION

An object of the present invention is to provide a fixing apparatus which can automatically remove a slackness of a web for supplying a mold release onto a surface of a fixing roller, and an image forming apparatus provided with the same.

In order to achieve the object, in accordance with the present invention, there is provided a fixing apparatus comprising:

- a fixing roller rotating together with a pressing roller and heating a toner image transferred to a recording medium so as to fix to the recording medium;
- a sheet impregnated with a mold release and supplying the mold release to a surface of the fixing roller;
- a first shaft around which the sheet is wound; a second shaft rotated by rotation driving means and taking up the sheet after supplying the mold release to the fixing roller; and
- tension applying means for applying a rotational force in a direction opposite to a direction of drawing out the sheet to the first shaft.

Accordingly, when a slackness is generated in the sheet and the tension is lost in the sheet, the first shaft is rotated in the direction opposite to the direction of drawing out the sheet by the tension applying means, so that the slackness of the sheet for supplying the mold release onto the surface of the fixing roller can be automatically removed. As in a manner mentioned above, since the slackness generated in the sheet at a time of replacing the unit for supporting the sheet and treating the jam can be removed, the mold release can be stably supplied to the fixing roller by the sheet, so that an image having a little offset and a high quality can be obtained.

DESCRIPTION OF THE PREFERRED EMBODIMENT

An embodiment in accordance with the present invention will be described below with reference to FIGS. 1 to 5.

Figure 1:
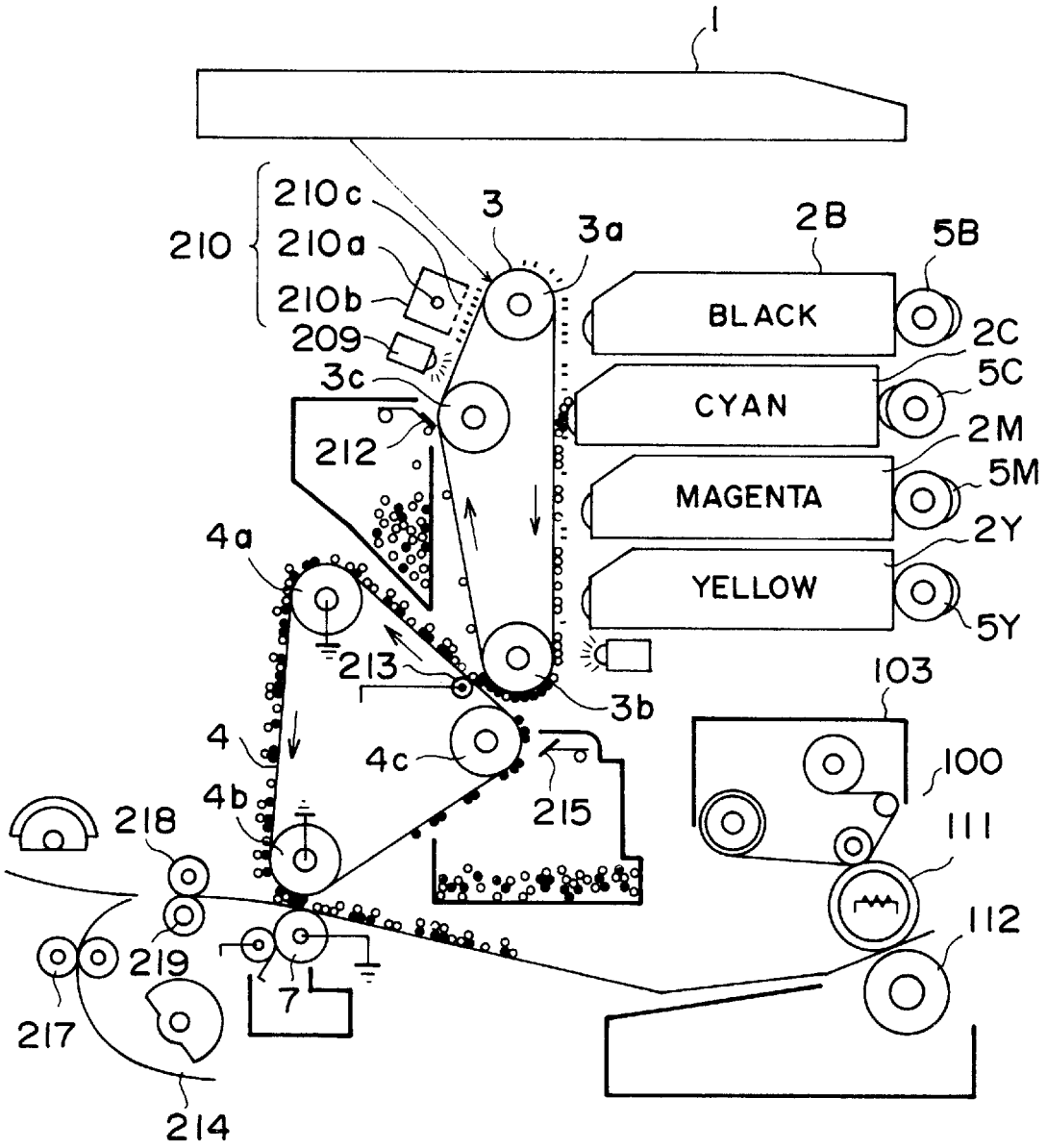
FIG. 1 is a schematic view which shows an inner structure of an image forming apparatus in accordance with an embodiment of the present invention.
Figure 2:
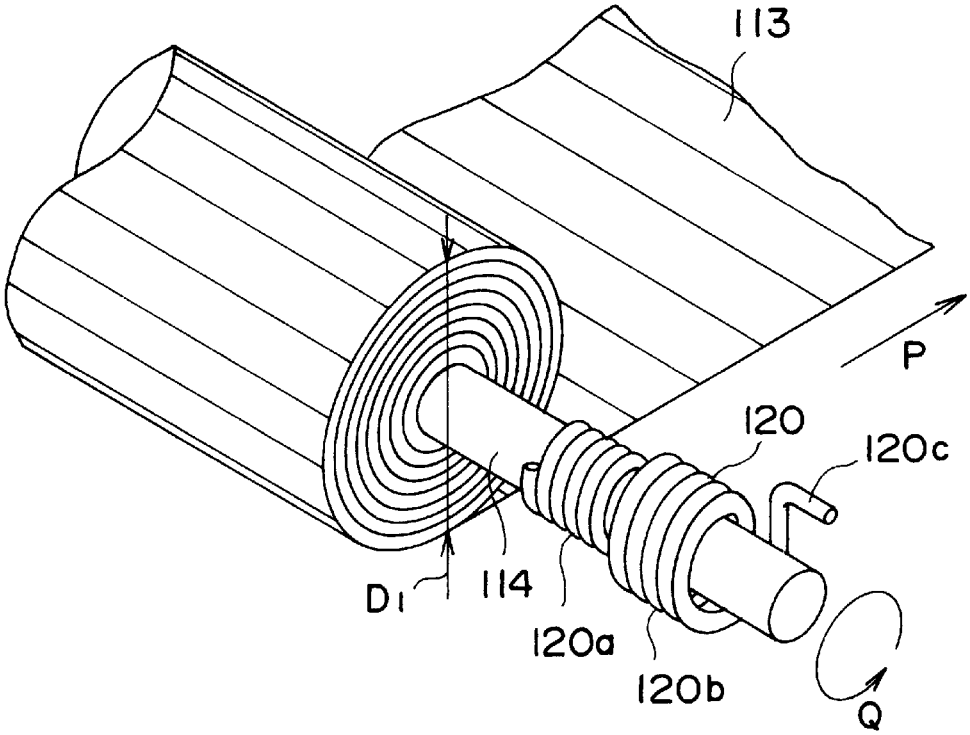
FIG. 2 is a perspective view which in detail shows a main portion of a web unit in a fixing apparatus mounted to the image forming apparatus shown in FIG. 1.
Figure 3:
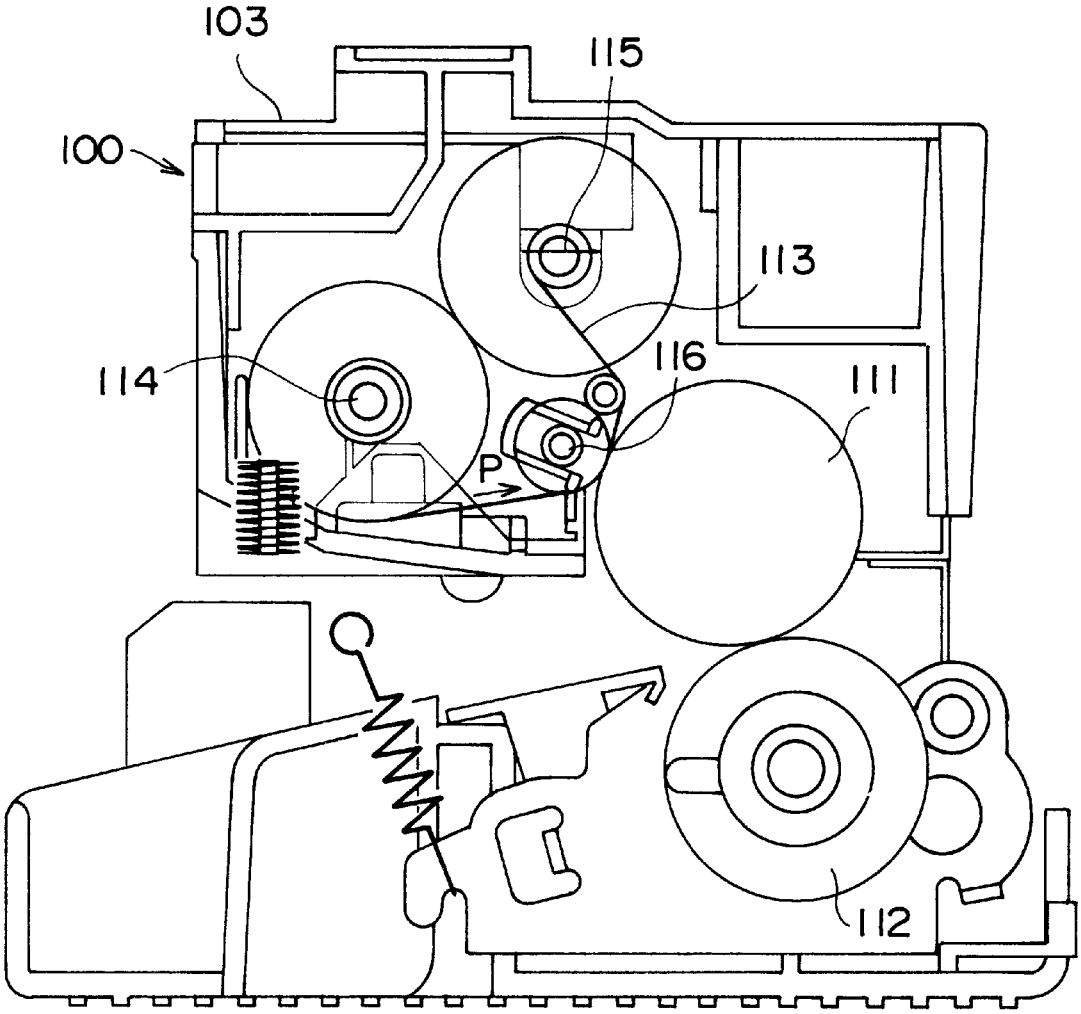
FIG. 3 is a schematic view which shows a structure of the fixing apparatus mounted to the image forming apparatus shown in FIG. 1.
Figure 4:
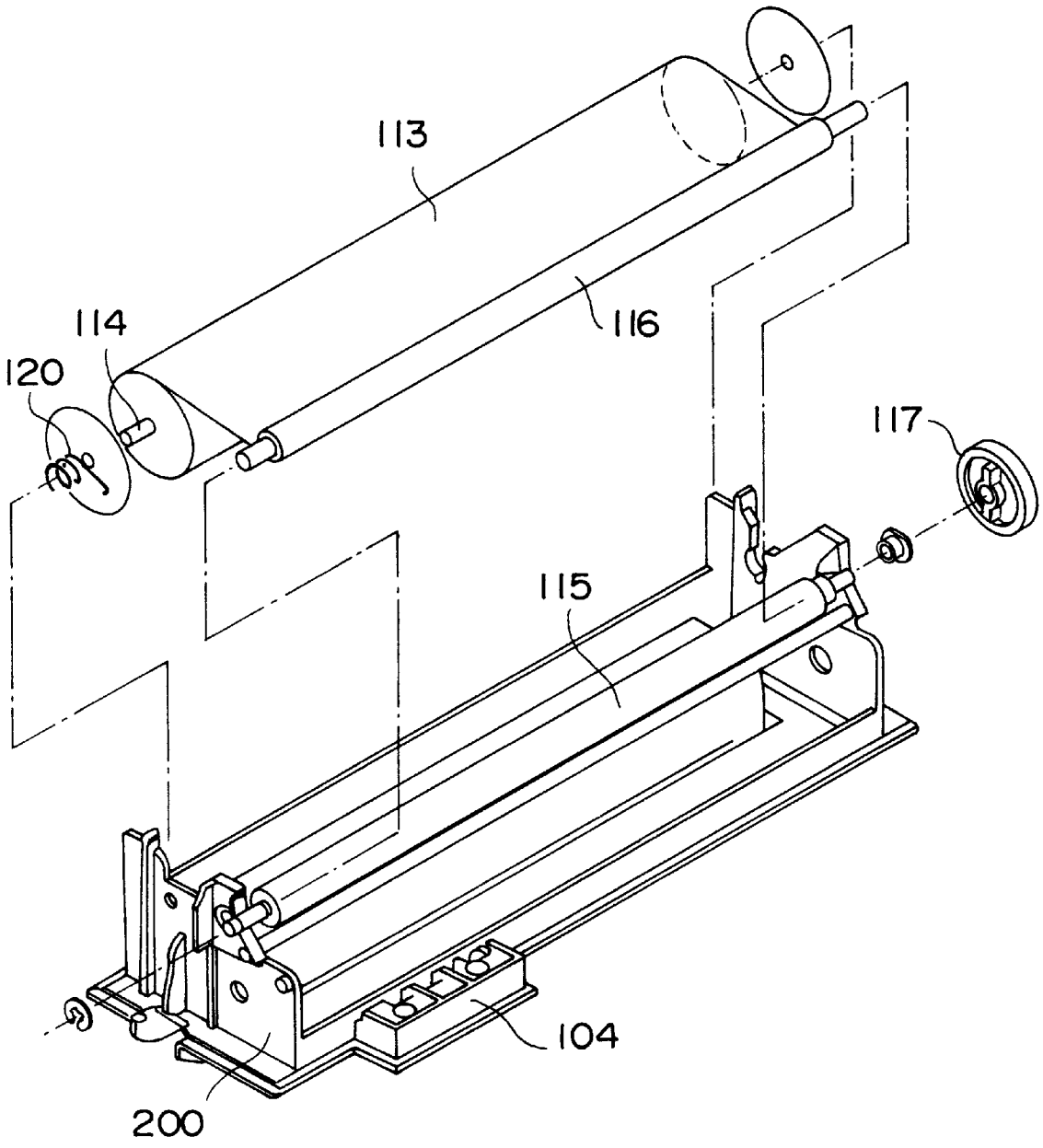
FIG. 4 is an exploded perspective view of the web unit in the fixing apparatus shown in FIG. 3.
Figure 5:
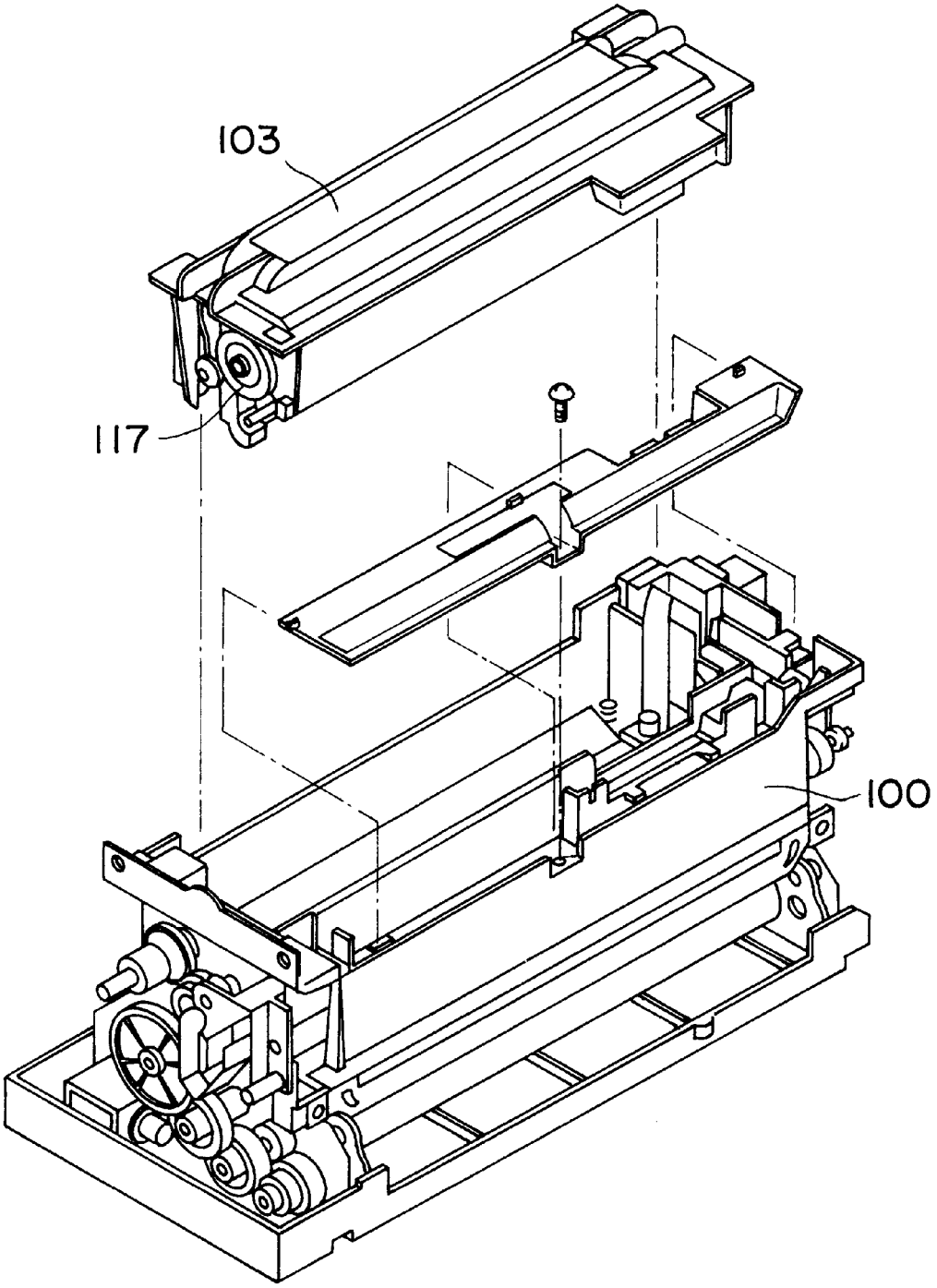
FIG. 5 is an exploded perspective view of the fixing apparatus shown in FIG. 3.

FIG. 1 is a schematic view which shows an inner structure of an image forming apparatus in accordance with an embodiment of the present invention, FIG. 2 is a perspective view which in detail shows a main portion of a web unit in a fixing apparatus mounted to the image forming apparatus shown in FIG. 1, FIG. 3 is a schematic view which shows a structure of the fixing apparatus mounted to the image forming apparatus shown in FIG. 1, FIG. 4 is an exploded perspective view of the web unit in the fixing apparatus shown in FIG. 3, and FIG. 5 is an exploded perspective view of the fixing apparatus shown in FIG. 3.

In FIG. 1, a photosensitive body belt (photosensitive body) 3, on which a photosensitive image receiving layer such as an organic photo conductor (OPC) and the like is coated in a thin film manner, is interlinked and supported by three photosensitive body belt supporting and conveying rollers 3*a*, 3*b* and 3*c* so as to form a vertical surface, and is circulated along the photosensitive body belt supporting and conveying rollers 3*a*, 3*b* and 3*c* by a driving motor. Developing units 2B, 2C, 2M and 2Y receiving toners respectively corresponding to black (B), cyan (C), magenta (M) and yellow (Y) are provided on the vertical surface of the photosensitive body belt 3 along an outer peripheral surface thereof. A photosensitive body cleaning apparatus 212 for removing a toner left in the photosensitive body belt 3, a discharging unit 209 having an LED lamp arranged in parallel and discharging the photosensitive body belt 3, and a charging unit 210 for charging the photosensitive body belt 3 due to a corona discharge are placed in the side of the photosensitive body belt 3, and further, a laser unit 1 is provided.

The charging unit 210 is constituted by a charging wire 210*a* comprising a tungsten wire and the like, a shield plate 210*b* comprising a metal plate and a grid plate 210*c*. Then, the charging wire 210*a* is corona discharged by applying a high voltage to the charging wire 210*a*, and the photosensitive body belt 3 is uniformly charged through the grid plate 210*c*. Further, a laser beam irradiated by the laser unit 1 is controlled in accordance with a signal from a host computer so as to form a plurality of electrostatic latent images respectively corresponding to specific components among a plurality of predetermined color components on the photosensitive body belt 3.

The developing units 2B, 2C, 2M and 2Y respectively corresponding to the colors are respectively arranged in predetermined receiving portions provided in the main body of the apparatus at a uniform interval and in a freely detachable manner, and an inner portion of each of the developing units is structured in the same manner except a kind of the received toner.

Contact cams 5B, 5C, 5M and 5Y for bringing the developing units 2B, 2C, 2M and 2Y into contact with the photosensitive body belt 3 at a time of developing the electrostatic latent image having a predetermined color are provided in correspondence to the respective developing units 2B, 2C, 2M and 2Y, and the developing units 2B, 2C, 2M and 2Y are held a standby position apart from the photosensitive body belt 3 at a time of not being pressed in a direction of the photosensitive body belt 3 by the contact cams 5B, 5C, 5M and 5Y.

An intermediate transferring body unit has an intermediate transferring body belt (an intermediate transferring body) 4 made of a conductive resin and the like, and three intermediate transferring body belt supporting and conveying rollers 4*a*, 4*b* and 4*c* for interlinking and supporting the intermediate transferring body belt 4. In order to transfer the toner image disposed on the photosensitive body belt 3 on the intermediate transferring body belt 4, an intermediate transferring roller 213 is arranged in such a manner as to be opposed to the photosensitive body belt 3 with respect to the intermediate transferring body belt 4.

In this case, a peripheral length of a surface of the intermediate transferring body belt 4 is set such as to be equal to a peripheral length of a surface of the photosensitive body belt 3. In order to scrape out a remaining toner on the intermediate transferring body belt 4, an intermediate transferring body belt cleaning apparatus 215 is placed near the intermediate transferring body belt supporting and conveying roller 4*c*. The intermediate transferring body belt cleaning apparatus 215 is apart from the intermediate transferring body belt 4 during a formation of a composite image on the intermediate transferring body belt 4, and is brought into contact with the intermediate transferring body belt 4 only at a time of being used for cleaning.

A paper cassette or the like for receiving a paper (a recording medium) 214 is provided in a lower portion of the apparatus. Then, the paper 214 is fed out to a paper conveying path from the paper cassette by a paper supply roller 217 one by one. In order to coincide a position of the paper 214 with a position of the composite image formed on the intermediate transferring body belt 4, a resist roller 218 for temporarily stopping the paper 214 and keeping the paper 214 at a standby position is provided in such a manner as to be brought into contact with a driven roller 219. Further, a medium transfer roller (a transfer roller) 7 for transferring the composite image formed on the intermediate transferring body belt 4 on the paper 214 by an application of a voltage having a polarity different from that of the toner is provided on the paper conveying path, and is rotated in such a manner as to be in contact with the intermediate transferring body belt 4 only at a time of transferring the composite image on the paper 214. The medium transfer roller 7 is, for example, made of a conductive foamed polyurethane. In this case, in addition to the paper 214, for example, an OHP film may be applied to the recording medium.

In order to fix the composite image transferred to the paper 214, a fixing apparatus 100 comprising a fixing roller 111 having a heat source therewithin and a pressing roller 112 is arranged. Then, the composite image transferred by a pressure and a heat together with a nipping and rotation between the fixing roller 111 and the pressing roller 112 when the sheet 214 passes within the fixing apparatus 100 is fixed on the paper 214, so that a color image is formed.

As illustrated, the fixing apparatus 100 is constituted by a web unit 103 detachably provided in the main body of the apparatus, the fixing roller 111 and the pressing roller 112.

Figure 6:
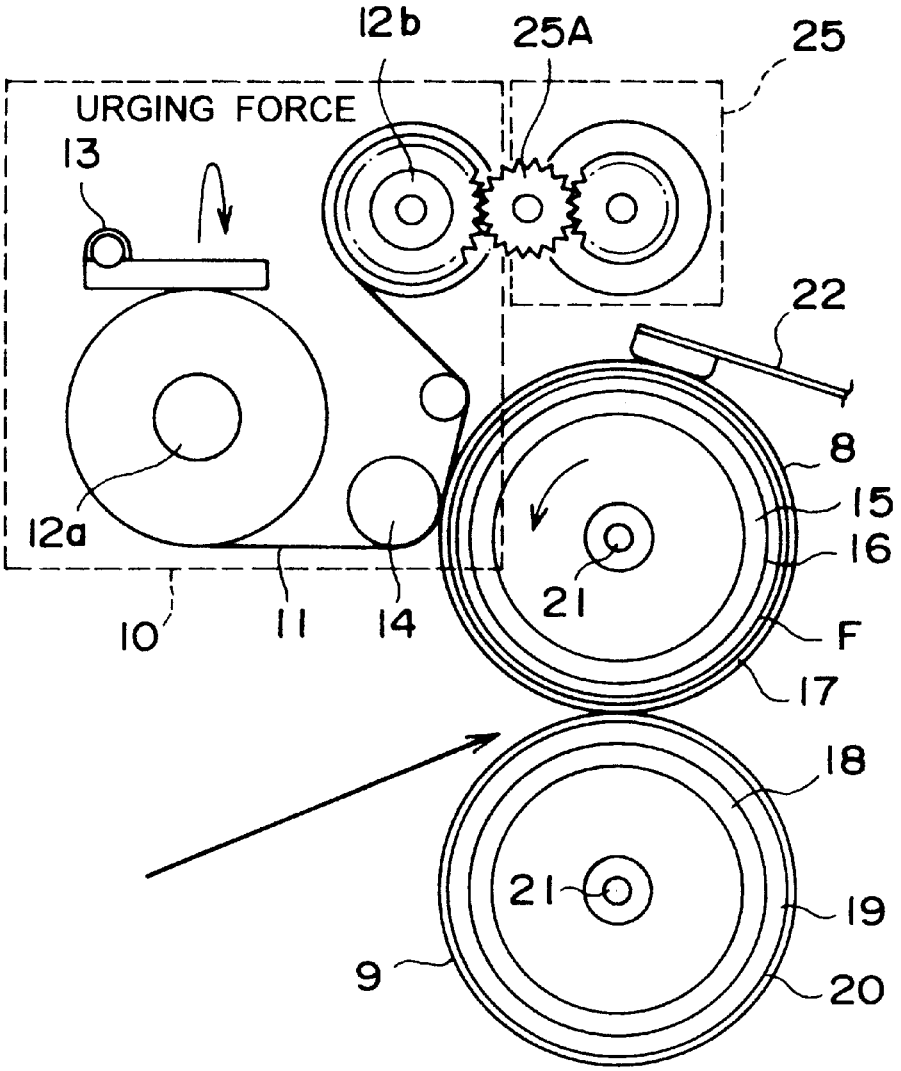
FIG. 6 is a schematic view which shows a structure of a fixing apparatus in a conventional image forming apparatus.

The fixing roller 111 is heated by an internal or external heat source so that a surface temperature thereof becomes 160° C. to 180° C. corresponding to an optimum fixing temperature. Further, the pressing roller 112 brought into contact with the fixing roller 111 and rotating together with a rotation of the fixing roller 111 cooperates with the fixing roller 111 and holds the conveyed unfixed toner image therebetween together with the paper. Further, the web unit 103 applies a silicone oil corresponding to a mold release to the fixing roller 111, and cleans a surface of the fixing roller 111 which is completed in the fixing operation. In this case, a structure of the fixing roller 111 and the pressing roller 112 is substantially the same as that of the fixing roller 8 and the pressing roller 9 illustrated in FIG. 6.

In this case, as shown in FIGS. 2, 3 and 4, the web unit 103 is constituted by a first shaft 114 around which a non-woven fabric impregnated with a mold release such as a silicone oil and the like or a sheet-like web 113 made of a porous material is wound, a second shaft 115 taking up the web 113, a pressing roller 116 for pressing the web 113 from an inner side to a longitudinal direction of the surface of the fixing roller 111 by a predetermined pressing force, judging means 104 comprising a resistance fuse and a resistance, and the like, and they are provided in a casing 200 of the web unit 103.

A web gear 117 for being connected to rotation driving means in the side of the main body so as to transmit the driving force when the fixing apparatus 100 is attached to the main body of the apparatus is mounted to an end of the second shaft 115.

A coil spring (tension applying means) 120 is fitted to an end of the first shaft 114. The coil spring 120 is structured such that a friction coil portion 120*a* shown in FIG. 2 is wound around an outer side of the first shaft 114 in a contact manner, and a frictional force is generated between an inner side of the friction coil portion 120*a* and an outer side of the first shaft 114 when the first shaft 114 rotates. A return force storing coil portion 120*b* is structured such as to be loosely wound around the first shaft 114 with an interval in subsequent to the friction coil portion 120*a* and generate a returning force when the first shaft 114 rotates. An end of the coil spring 120 is wound around an outer side of the shaft 114 as mentioned above, and a hook portion 120*c* at the other end is mounted to a locking portion serving as a rotation prevention for the coil spring 120 provided in the casing 200 for supporting the first shaft 114 and the second shaft 115.

The operation of the image forming apparatus structured in a manner mentioned above, will be described below.

In FIG. 1, after uniformly discharging the charged photosensitive body belt 3 by the discharging unit 209, a high voltage is applied to the charging wire 210*a* within the charging unit 210 connected to the high voltage power source so as to perform a corona discharge, thereby uniformly charging the surface of the photosensitive body belt 3 to a level of about −500 v to −650 v.

Next, the photosensitive body belt 3 is circulated by a drive apparatus such as a motor and the like, so that a laser beam corresponding to an image of a predetermined color, for example, a black (B) among a plurality of color components is irradiated on the surface of the uniformly charged photosensitive body belt 3 by the laser unit 1. Accordingly, an electric charge disappears from a portion on which the laser beam is irradiated on the photosensitive body belt 3 and a electrostatic latent image is formed thereon. On the contrary, a developing unit 2B receiving the toner of the black used for development is brought into contact with the photosensitive body belt 3 in accordance that the contact cam 5B half rotates by a color selecting signal from the host computer and the like. Then, a thin-layered toner to which a predetermined voltage is applied is attached to the electrostatic latent image, so that the toner image can be formed.

The developing unit 2B in which the development is finished in this manner moves to a standby (an apart) position from the contact position with the photosensitive body belt 3 in accordance that the contact cam 5B further half rotates. In this case, during a development of the developing unit 2B, the other developing units 2C, 2M and 2Y are apart from the photosensitive body belt 3.

Next, for example, when a color of a cyan (C) is selected, the developing unit 2C is brought into contact with the photosensitive body belt 3, and starts a development of a cyan by the same operation as that mentioned above. In the case of using four colors, the operation of this development is successively repeated four times, and the four-layered toner image corresponding to four colors B, C, M and Y is transferred on the intermediate transfer body belt 4 in an overlapping manner, so that the composite image is formed thereon. In this case, single layer toner image, two layers toner image and three layers toner image are respectively formed in the case of a color, two colors and three colors.

A little toner left on the photosensitive body drum 3 without being transferred is cleaned by the photosensitive body cleaning apparatus 212 and waits for the next process.

The composite image formed in this manner is wholly transferred to the paper 214 conveyed from the paper cassette along the paper conveying path when a high voltage having a polarity opposite to that of the toner is applied to the medium transferring roller 7.

The paper 214 on which the composite image is transferred is successively conveyed to the fixing apparatus 100. Then, the paper is fixed by heat and a nipping force between the fixing roller 111 and the pressing roller 112 here, so that the color image is formed. The paper 214 passing through the fixing apparatus 100 is discharged to a paper discharge tray.

In this case, a little toner left on the intermediate transfer body belt 4 without being transferred is cleaned in accordance that the intermediate transfer body belt cleaning apparatus 215 is brought into contact with the toner by the drive means such as an electromagnetic clutch and the like, and wait for the next process.

Next, an operation of the fixing apparatus 100 structured in the manner mentioned above will be described below.

As already mentioned, the web 113 is wound around the first shaft 114 so as to form a roll, thereby forming a web roll. Then, the web 113 is drawn out in a direction of an arrow P shown in FIG. 2 from the first shaft 114 due to a rotation driving of the second shaft 115.

In this case, since a coil spring 120 is fitted to an end of the first shaft 114, and an inner diameter of a friction coil portion 120*a* of the coil spring 120 is set substantially equal to an outer diameter of the first shaft 114 and strongly wound in a pressure contact state, a load torque T1 is generated in the first shaft 114 in accordance with a friction force due to contact between the first shaft 114 and the friction coil portion 120*a* when the web 113 is drawn out and the first shaft 114 rotates in a direction of an arrow Q. Further, when the outer diameter of the web roll is set to D1, a tension of T1×2/D1 is applied to the taken-up web 113.

Further, the return force storing coil portion 120*b* is set to have an inner diameter larger than the outer diameter of the first shaft 114, and is wound with a certain interval with respect to the first shaft 114. Accordingly, when the first shaft 114 rotates in a direction of an arrow Q, the load torque T1 generated in the friction coil portion 120*a* is transmitted to the return force storing coil portion 120*b*, and the return force storing coil portion 120*b* receives a force having a torque T1 in a direction of the arrow Q, so that the coil diameter thereof is enlarged. Then, a torque T2 applied to the return force storing coil portion 120*b* in a direction opposite to the direction of the arrow Q so as to intend to return to an original state when the coil diameter of the return force storing coil portion 120*b* is expanded is balanced with the load torque T1, whereby the tension (T1×2/D1) to the web 113 can be maintained.

Accordingly, when a slackness is generated in the web 113 at a time of replacing the web unit and treating a jam and the tension of the web 113 is lost, the first shaft 114 rotates in a direction opposite to the direction of drawing out the web 113 due to the opposite torque T2 stored in the return force storing coil portion 120*b* of the coil spring 120, so that the slackness of the web 113 is automatically removed.

In this case, the tension applying means is not always the coil spring 120 in accordance with the present embodiment, and any other structure can be employed as far as the rotating force in the direction opposite to the direction of drawing out the web 113 can be applied to the first shaft 114.

As mentioned above, in accordance with the present invention, when the slackness is generated in the web 113 and the tension of the web 113 is lost, the first shaft 114 rotates in the direction opposite to the direction of drawing out the web 113, so that an advantageous effect that the slackness of the web 113 supplying the mold release on the surface of the fixing roller 111 is automatically removed can be obtained.

In this case, when the tension applying means is constituted by the single coil spring 120, an advantageous effect that the fixing apparatus 100 which is inexpensive and excellent in a space is achieved can be obtained.

As mentioned above, since the slackness generated in the web at a time of replacing the web unit 103 and treating a jam can be removed, the mold release can be stably supplied to the fixing roller 111 by the web 113, so that an advantageous effect that a high quality image having a little offset is achieved can be obtained.

What is claimed is:

1. A fixing apparatus comprising:

a pressing roller;

a fixing roller rotating together with said pressing roller and heating a toner image transferred to a recording medium so as to fix said toner image to the recording medium;

a sheet impregnated with a mold release for supplying the mold release to a surface of said fixing roller;

a first shaft around which said sheet is wound;

a second shaft rotated by rotation driving means for taking up said sheet after supplying said mold release to said fixing roller; and tension applying means for applying a rotational force in a direction opposite to a direction of drawing out said sheet to said first shaft, wherein said tension applying means comprises a coil spring comprising:

a friction coil portion brought into contact with said first shaft so as to be wound around the first shaft;

a storing coil portion connected to said friction coil portion and wound around said first shaft with a space between said first shaft and said storage coil portion; and a hook portion connected to said storing coil portion and mounted to a casing for supporting said first shaft.

2. A fixing apparatus comprising:

a pressing roller;

a fixing roller rotating together with said pressing roller and heating a toner image transferred to a recording medium so as to fix said toner image to the recording medium;

a sheet impregnated with a mold release for supplying the mold release to a surface of said fixing roller;

a first shaft around which said sheet is wound;

a second shaft rotated by rotation driving means for taking up said sheet after supplying said mold release to said fixing roller; and tension applying means for applying a rotational force in a direction opposite to a direction of drawing out said sheet to said first shaft, wherein said tension applying means comprises a coil spring comprising:

a friction coil portion brought into contact with said first shaft so as to be wound around the first shaft and for applying a frictional force to the first shaft when said first shaft rotates in a direction in which said sheet is drawn out;

a return force storing coil portion connected to said friction coil portion, wound around said first shaft with a space between said first shaft and said storing coil portion and applying a rotational force in a direction opposite to the rotational direction of said first shaft when said sheet is drawn out to the first shaft; and a hook portion connected to said return force storing coil portion and mounted to a casing for supporting said first shaft.

* * * * *